US006184841B1

(12) United States Patent
Shober et al.

(10) Patent No.: US 6,184,841 B1
(45) Date of Patent: Feb. 6, 2001

(54) ANTENNA ARRAY IN AN RFID SYSTEM

(75) Inventors: R. Anthony Shober, Red Bank; Eric Sweetman, Princeton; You-Sun Wu, Princeton Junction, all of NJ (US)

(73) Assignee: Lucent Technologies Inc., Murray Hill, NJ (US)

( * ) Notice: Under 35 U.S.C. 154(b), the term of this patent shall be extended for 0 days.

(21) Appl. No.: 08/775,217

(22) Filed: Dec. 31, 1996

(51) Int. Cl.[7] ..... H01Q 21/00

(52) U.S. Cl. ..... 343/853; 343/850; 342/44; 455/41

(58) Field of Search ..... 343/700 MS, 813, 343/814, 844, 853, 850, 858, 860, 778; 342/42, 44, 51; 455/41, 49, 54

(56) References Cited

U.S. PATENT DOCUMENTS

| | | |
|---|---|---|
| 3,720,940 | 3/1973 | Koelle . |
| 3,938,052 | 2/1976 | Glasson et al. . |
| 3,944,928 | 3/1976 | Augenblick et al. . |
| 3,984,835 | 10/1976 | Kaplan et al. . |
| 3,997,847 | 12/1976 | Tong . |
| 4,068,232 | 1/1978 | Meyers et al. . |
| 4,075,632 | 2/1978 | Baldwin et al. . |
| 4,360,810 | 11/1982 | Landt . |
| 4,471,345 | 9/1984 | Barrett, Jr. . |
| 4,510,495 | 4/1985 | Sigrimis et al. . |
| 4,584,534 | 4/1986 | Lijphart et al. . |
| 4,641,374 | 2/1987 | Oyama . |
| 4,656,463 | 4/1987 | Anders et al. . |
| 4,691,202 | 9/1987 | Denne et al. . |
| 4,739,328 | 4/1988 | Koelle et al. . |
| 4,816,839 | 3/1989 | Landt . |
| 4,827,395 | 5/1989 | Anders et al. . |
| 4,888,591 | 12/1989 | Landt et al. . |

(List continued on next page.)

FOREIGN PATENT DOCUMENTS

| | | | |
|---|---|---|---|
| 0 313 491 A1 | * | 4/1989 | (EP) . |
| 0 346 922 A2 | * | 12/1989 | (EP) . |
| 0 670 558 A2 | | 2/1995 | (EP) . |
| 0 724 351 A2 | | 7/1996 | (EP) . |
| 0 732 597 A1 | * | 9/1996 | (EP) . |
| 0 750 200 | | 12/1996 | (EP) . |
| 1 098 431 | | 11/1982 | (GB) . |
| 2 193 359 | | 2/1988 | (GB) . |
| 2 202 415 | | 9/1988 | (GB) . |
| S63-52082 | | 3/1988 | (JP) . |
| WO 89/05549 | | 6/1989 | (WO) . |
| WO 94/19781 | | 9/1994 | (WO) . |

OTHER PUBLICATIONS

"A Microwave Noncontact Identification Transponder Using Subharmonic Interrogation," Carol W. Pobanz, 8099 IEEE Transactions on Microwave Theory and Techniques, 43 (1995), Jul., No. 7, PT. II, New York, US, pp. 1673–1679.*

(List continued on next page.)

*Primary Examiner*—Don Wong
*Assistant Examiner*—Tho Phan
(74) *Attorney, Agent, or Firm*—Christopher N. Malvone

(57) ABSTRACT

In accordance with the present invention, a general antenna system is disclosed suitable for applications in which an RFID Tag passes by an Interrogator. We then disclose a specific antenna design that uses a single planar antenna for transmit and a multi-element planar antenna array for receive. The multi-element planar antenna array is spaced such that each of the planar elements is four inches apart, center-to-center, thus defining a narrow 30° receive beam-width in the horizontal plane. The vertical receive bandwidth is much greater than 30°, facilitating the Interrogator receiving signals at a variety of elevations. Furthermore, a multi-way microstrip combiner is used to sum the signals received from each of the planar antennas. To block interference from the transmit antenna and to improve receive sensitivity, this multi-way microstrip combiner is shielded using, in one embodiment, copper tape along its edges. In a specific embodiment, a four element receive antenna design is disclosed.

10 Claims, 6 Drawing Sheets

U.S. PATENT DOCUMENTS

| | | | | |
|---|---|---|---|---|
| 4,912,471 | | 3/1990 | Tyburski . | |
| 4,937,581 | | 6/1990 | Baldwin et al. . | |
| 4,963,887 | | 10/1990 | Kawashima et al. . | |
| 4,993,068 | | 2/1991 | Piosenka et al. . | |
| 5,030,807 | | 7/1991 | Landt et al. . | |
| 5,039,994 | * | 8/1991 | Wash et al. | 343/816 |
| 5,055,659 | | 10/1991 | Hendrick et al. . | |
| 5,086,391 | | 2/1992 | Chambers . | |
| 5,131,038 | | 7/1992 | Puhl et al. . | |
| 5,164,985 | | 11/1992 | Nysen et al. . | |
| 5,214,409 | | 5/1993 | Beigel . | |
| 5,214,410 | | 5/1993 | Vertser . | |
| 5,227,803 | | 7/1993 | O'Connor et al. . | |
| 5,251,218 | | 10/1993 | Stone et al. . | |
| 5,252,979 | | 10/1993 | Nysen . | |
| 5,264,954 | | 11/1993 | Okada . | |
| 5,305,008 | | 4/1994 | Turner et al. . | |
| 5,305,459 | | 4/1994 | Rydel . | |
| 5,317,309 | | 5/1994 | Vercellotti et al. . | |
| 5,339,073 | | 8/1994 | Dodd et al. . | |
| 5,347,263 | | 9/1994 | Carroll et al. . | |
| 5,381,137 | | 1/1995 | Ghaem et al. . | |
| 5,390,339 | | 2/1995 | Bruckert et al. . | |
| 5,400,949 | | 3/1995 | Hirvonen et al. . | |
| 5,420,757 | | 5/1995 | Eberhardt et al. . | |
| 5,423,056 | | 6/1995 | Linquist et al. . | |
| 5,426,667 | | 6/1995 | van Zon . | |
| 5,434,572 | | 7/1995 | Smith . | |
| 5,448,110 | | 9/1995 | Tuttle et al. . | |
| 5,448,242 | | 9/1995 | Sharpe et al. . | |
| 5,455,575 | | 10/1995 | Schuermann . | |
| 5,461,385 | | 10/1995 | Armstrong . | |
| 5,463,402 | | 10/1995 | Walrath et al. . | |
| 5,477,215 | | 12/1995 | Mandelbaum . | |
| 5,479,160 | | 12/1995 | Koelle . | |
| 5,479,416 | | 12/1995 | Snodgrass et al. . | |
| 5,485,520 | | 1/1996 | Chaum et al. . | |
| 5,491,484 | | 2/1996 | Schuermann . | |
| 5,510,795 | | 4/1996 | Koelle . | |
| 5,521,944 | | 5/1996 | Hegeler et al. . | |
| 5,523,749 | | 6/1996 | Cole et al. . | |
| 5,525,993 | | 6/1996 | Pobanz et al. . | |
| 5,525,994 | | 6/1996 | Hurta et al. . | |
| 5,530,202 | | 6/1996 | Dais et al. . | |
| 5,543,798 | | 8/1996 | Schuermann . | |
| 5,559,828 | | 9/1996 | Armstrong et al. . | |
| 5,572,222 | * | 11/1996 | Mailandt et al. | 343/700 MS |
| 5,581,576 | | 12/1996 | Lanzetta et al. . | |
| 5,590,158 | | 12/1996 | Yamaguchi et al. . | |
| 5,600,538 | | 2/1997 | Xanthopoulos . | |
| 5,610,939 | | 3/1997 | Takahashi et al. . | |
| 5,633,613 | * | 5/1997 | MacDonald | 343/700 MS |
| 5,640,683 | | 6/1997 | Evans et al. . | |
| 5,649,295 | | 7/1997 | Shober et al. . | |
| 5,649,296 | | 7/1997 | MacLellan et al. . | |
| 5,686,920 | | 11/1997 | Hurta et al. . | |
| 5,686,928 | * | 11/1997 | Pritchett et al. | 343/815 |
| 5,708,444 | * | 1/1998 | Pouwels et al. | 343/700 MS |

OTHER PUBLICATIONS

"A Coded Radar Reflector For Remote Identification Of Personnel And Vehicles," Frank R. Williamson, Lacey F. Moore, Ralph Brooks, Julie Anne Williamson, and Melvin C. McGee, Record of the 1993 IEEE National Radar Conference, Lynnfield, MA, USA, Apr. 20–22, 1993, ISBN 0–7803–0934–0, pp. 186–191.*

* cited by examiner

ANTENNA ARRAY IN AN RFID SYSTEM

RELATED APPLICATIONS

Related subject matter is disclosed in the following applications filed concurrently herewith and assigned to the same Assignee hereof: U.S. patent applications "Shielding Technology In Modulated Backscatter System," Ser. No. 08/777,770; "Encryption for Modulated Backscatter Systems," Ser. No. 08/777,832; "QPSK Modulated Backscatter System," Ser. No. 08/782,026; "Modulated Backscatter Location System," Ser. No. 08/777,643; "Modulated Backscatter Sensor System," Ser. No. 08/777,771; "Subcarrier Frequency Division Multiplexing Of Modulated Backscatter Signals," Ser. No. 08/775,701; "IQ Combiner Technology In Modulated Backscatter System," Ser. No. 08/775,695 which issued on Jul. 21, 1998 as U.S. Pat. No. 5,784,686; "In-Building Personal Pager And Identifier," Ser. No. 08/775,738, now abandoned; "In-Building Modulated Backscatter System," Ser. No. 08/777,834; "Inexpensive Modulated Backscatter Reflector," Ser. No. 08/774,499; "Passenger, Baggage, And Cargo Reconciliation System," Ser. No. 08/782,026. Related subject matter is also disclosed in the following applications assigned to the same assignee hereof: U.S. patent application Ser. No. 08/504,188, entitled "Modulated Backscatter Communications System Having An Extended Range"; U.S. patent application Ser. No 08/492,173, entitled "Dual Mode Modulated Backscatter System"; U.S. patent application Ser. No. 08/492,174, entitled "Full Duplex Modulated Backscatter System"; and U.S. patent application Ser. No. 08/571,004, entitled "Enhanced Uplink Modulated Backscatter System".

BACKGROUND OF THE INVENTION

1. Field of the Invention

This invention relates to wireless communication systems and, more particularly, to antenna technology used in a radio frequency identification communication system.

2. Description of the Related Art

Radio Frequency Identification (RFID) systems are used for identification and/or tracking of equipment, inventory, or living things. RFID systems are radio communication systems that communicate between a radio transceiver, called an Interrogator, and a number of inexpensive devices called Tags or transponders. In RFID systems, the Interrogator communicates to the Tags using modulated radio signals, and the Tags respond with modulated radio signals. FIG. 1 illustrates a Modulated Backscatter (MBS) system. In a MBS system, after transmitting a message to the Tag (called the Downlink), the Interrogator then transmits a Continuous-Wave (CW) radio signal to the Tag. The Tag then modulates the CW signal, using MBS, where the antenna is electrically switched, by the modulating signal, from being an absorber of RF radiation to being a reflector of RF radiation. Modulated backscatter allows communications from the Tag back to the Interrogator (called the Uplink). Another type of RFID system uses an Active Uplink (AU). FIG. 2 illustrates an Active Uplink RFID system. In an AU system, the RFID Tag does not modulate and reflect an incoming CW signal, but rather synthesizes an RF carrier, modulates that RF carrier, and transmits that modulated carrier to the Interrogator. In some AU systems, the RF carrier used in the Uplink is at or near the same frequency as that used in the Downlink; while in other AU systems, the RF carrier used in the Uplink is at a different frequency than that used in the Downlink.

Conventional RFID systems are designed a) to identify an object passing into range of the Interrogator, and b) to store data onto the Tag and then retrieve that data from the Tag at a later time in order to manage inventory or perform some other useful application. In some RFID applications, directional antennas are used. For example, in an RFID-based electronic toll collection system, the Interrogator is overhung on top of the highway (see FIG. 3). In this application, the transmit and receive antennas have the same beamwidth. In fact, transmit and receive frequently share the same antenna, using a circulator to separate the transmit and receive paths.

SUMMARY OF THE INVENTION

In accordance with an embodiment of the present invention, a general antenna system is disclosed suitable for applications in which an RFID Tag passes by an Interrogator. We then disclose an embodiment that uses a single planar antenna for transmit and a multi-element planar antenna array for receive. The multi-element planar antenna array is spaced such that each of the planar elements is four inches apart, center-to-center, thus defining a narrow 30° receive beamwidth in the horizontal plane. The vertical receive bandwidth is much greater than 30°, facilitating the Interrogator receiving signals at a variety of elevations. Furthermore, a multi-way microstrip combiner is used to sum the signals received from each of the planar antennas. To block interference from the transmit antenna and to improve receive sensitivity, this multi-way microstrip combiner is shielded using, in one embodiment, copper tape along its edges. In yet another specific embodiment, a four element receive antenna design is disclosed.

In this application, we disclose antenna technology suitable for a Cargo Tag system, which is an RFID-based system for tracking cargo containers. This application is used as a point of discussion, however the methods discussed here are not limited to a Cargo Tag system. The goal of the Cargo Tag system is to identify the contents of a Tag affixed to a cargo container when that cargo container comes within range of the Interrogator. The cargo container passes the gate of a warehouse at a certain speed, e.g. 10 meters/second, and the Interrogator, located behind and to the side of the passageway, is required to read the Tag. To save battery life in the Tag, the electronics, such as the microprocessor, of the Tag are "asleep" most of the time. Therefore, the Tag must be awakened by the Interrogator so that communications between the Interrogator and the Tag can begin. After the Tag is awakened, the antenna system must be designed for optimal communications.

In this disclosure, we describe a general antenna system that is suitable for applications in which an RFID Tag passes by an Interrogator. We then disclose a specific antenna system design, based upon the design of the general antenna system, that is well suited for Cargo Tag applications. This antenna system provides transmit and receive antennas that are small in size, light in weight, low in cost, and provides appropriate beam widths for these applications.

DETAILED DESCRIPTION

Figure 1:
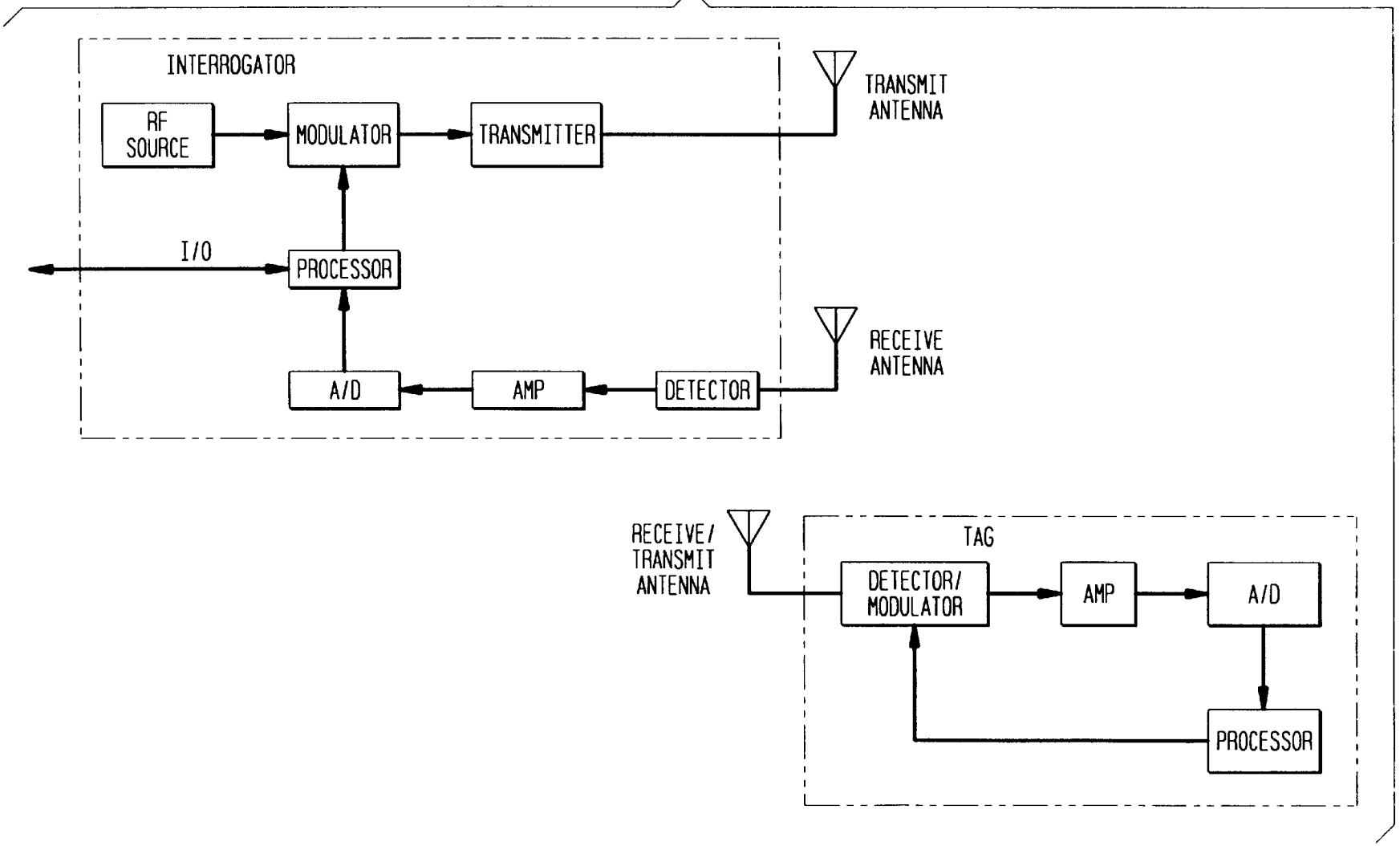
FIG. 1 illustrates a Modulated Backscatter RFID system.
Figure 2:
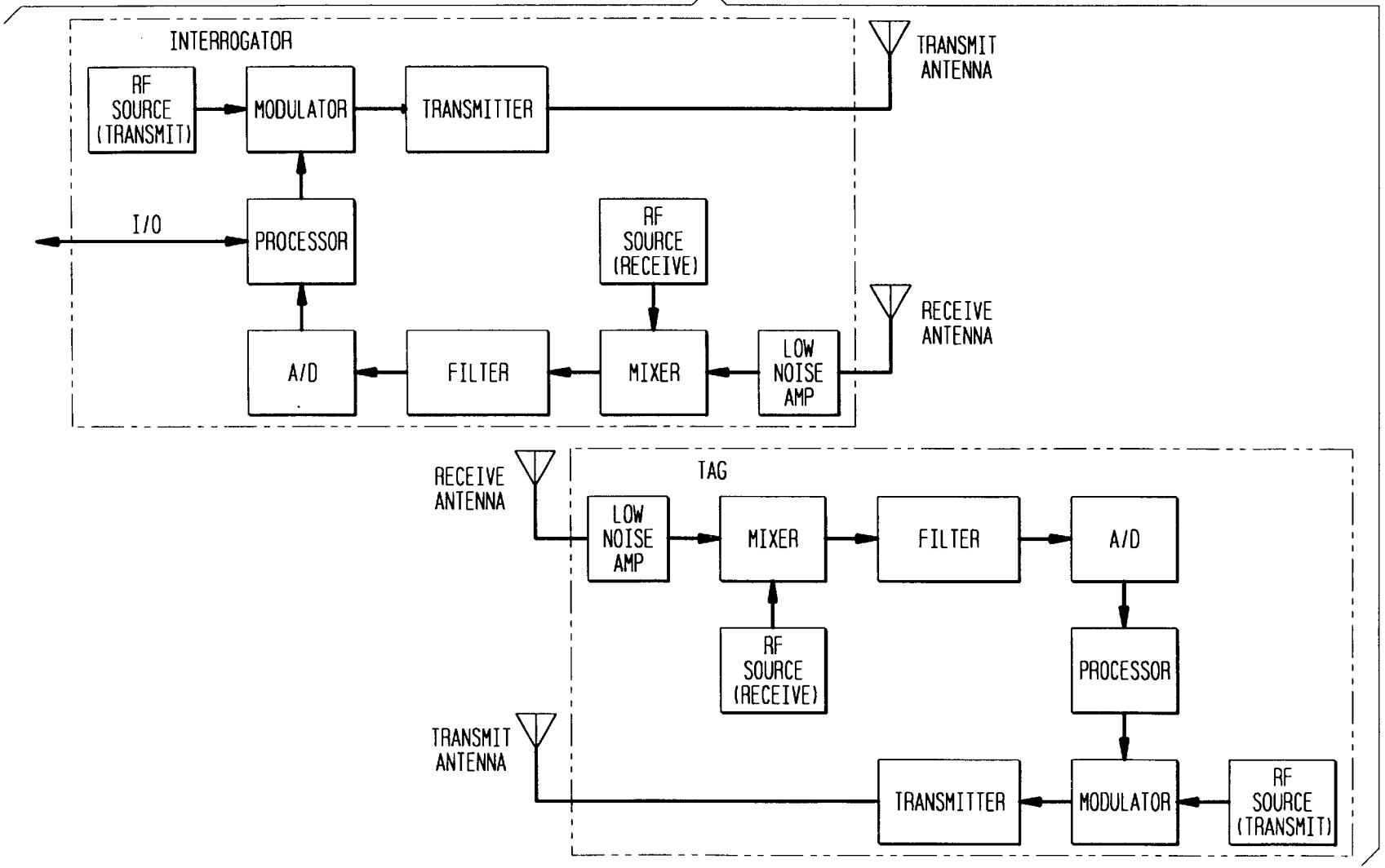
FIG. 2. Illustrates an Active Uplink RFID system.
Figure 3:
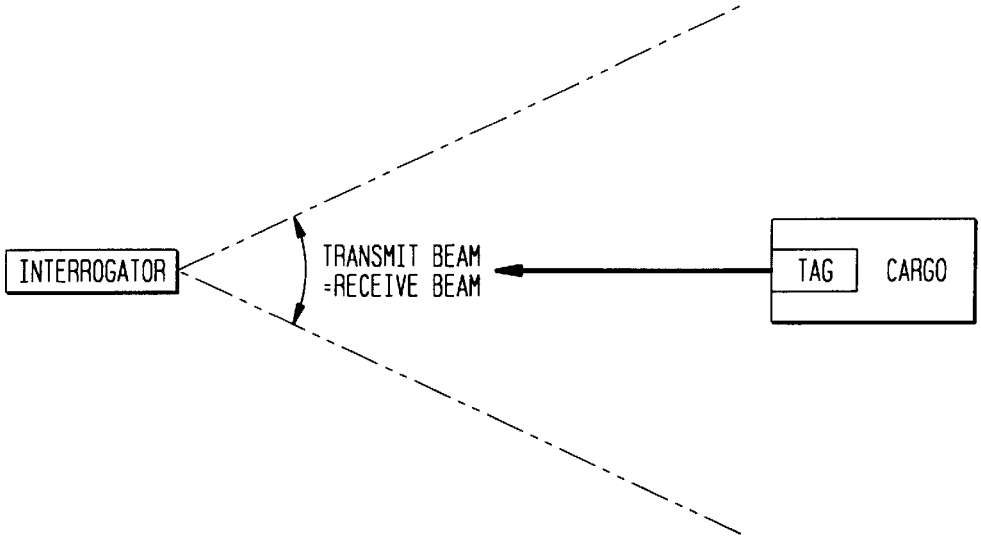
FIG. 3 shows the top view of a toll-collection RFID system.
Figure 4:
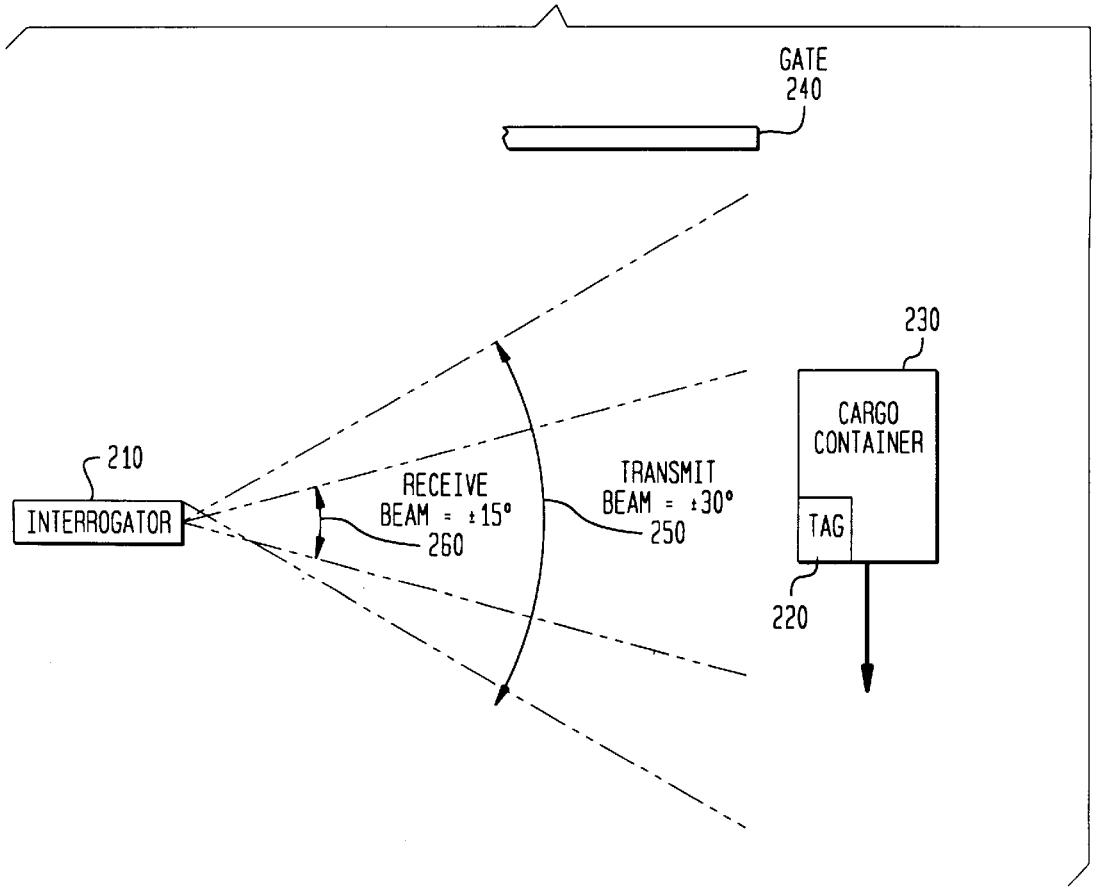
FIG. 4 shows the top view of a cargo tag RFID system.

We now consider the desirable characteristics of an antenna system for the Cargo Tag application. In FIG. 4, the Tag (220) is affixed to a Cargo Container (230), and moves through a Gate (240) and past the Interrogator (210).

The Interrogator (210) regularly transmits an RF signal to the Tag (220); this RF signal contains at least timing information such that the Tag can achieve time synchronization with the Interrogator. Generally, at least two types of time synchronization are required; bit and frame. Bit synchronization means that the Tag has sufficient timing information to know when to expect the beginning of each Downlink bit. Frame synchronization means that the Tag has sufficient timing information to know when to begin to transmit Uplink data. The Interrogator must therefore first transmit a signal to the Tag (220) which causes the Tag to awaken, and to acquire both bit and frame synchronization. For optimum performance, the Tag must be fully awaken, and time synchronized, by the time that the Tag passes into the Interrogator's receive antenna pattern. Generally, the Downlink signal to noise ratio for the Tag to achieve bit and frame synchronization is not as great as the Uplink signal to noise ratio required for the Interrogator to accurately receive data. Therefore, we desire the Tag to first awaken and achieve bit and frame synchronization, perhaps even before the time that the Uplink communications path is clear enough for reliable Uplink data transmission. Therefore, the Downlink Transmit Beam (250) should have a wider, in the horizontal plane, beamwidth than the Uplink Receive Beam (260). This will enable the Tag to achieve bit and frame synchronization with respect to the Interrogator (210) before beginning the Uplink communication of data.

FIG. 4 shows a specific embodiment of this general principle. The Interrogator transmits using a (relatively) wide Transmit Beam (250), in this embodiment ±30°, such that the Tag (220) can synchronize its clock with the Interrogator (210) before the Tag reaches the optimal reading volume in front of the Interrogator. After wake up, the Tag (220) enters the Receive Beam (260), which in this embodiment has a horizontal beamwidth of ±15°. In an AU system, the Tag they transmits data back to the Interrogator as described above; in an MBS system, the Tag responds by modulating and reflecting a CW microwave signal transmitted by the Interrogator (210). Thus, Uplink (i.e., Tag (220) to Interrogator (210)) communications take place while the Tag (220) is located in the Receive Beam. Since the Receive Beam (260) has narrower bandwidth, and therefore more antenna gain, that additional gain improves the performance of the Uplink signals and enhances the reliability of the Uplink communications path.

Figure 5:
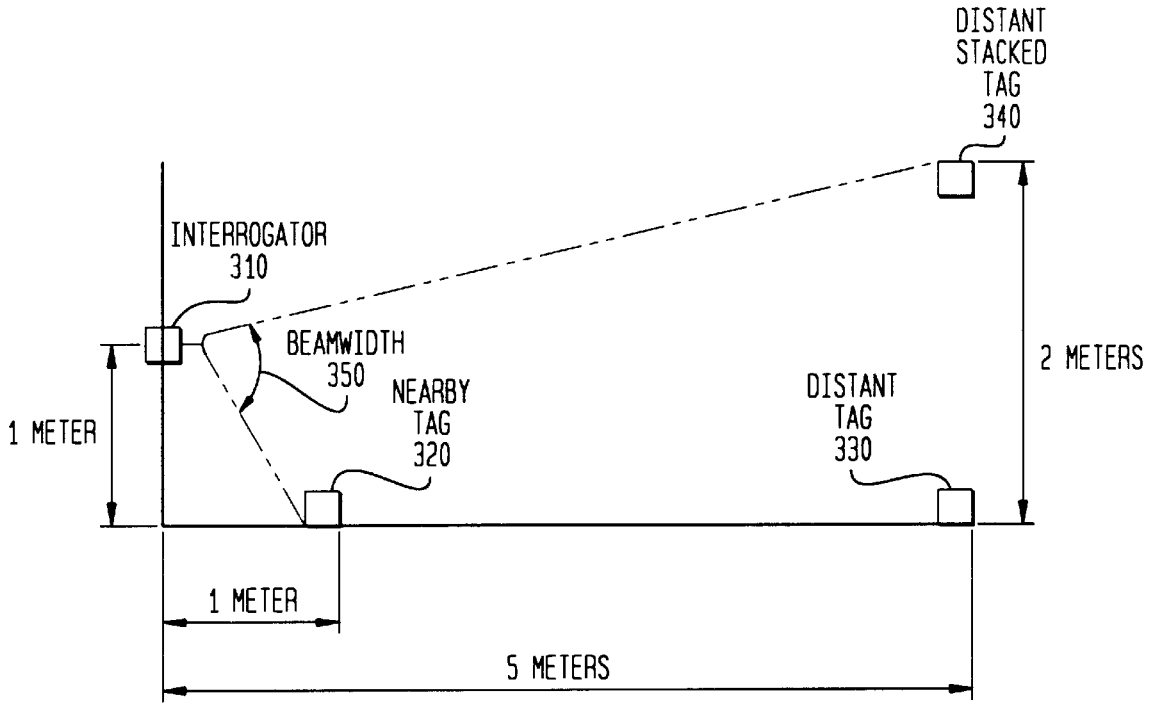
FIG. 5 shows the relationship between the Interrogator and Cargo Tags as they move past the Interrogator.

We now examine further the required characteristics of the Receive Beam (260). We note that, for applications such as the Cargo Tag, the Tag (220) may pass by the Interrogator at a number of different elevations. For example, assume the Cargo Container (230) to which this particular Cargo Tag (220) is attached passes very closely by the Interrogator (210). Let us assume that the Interrogator (210) is positioned one meter above ground level. Then, if the Cargo Tag (220) is mounted at or near the bottom of the Cargo Container (230), the Cargo Tag (220) will pass by the Interrogator (210) at an elevation which could be below that of the Interrogator. This case is illustrated in FIG. 5 as the Nearby Tag (320). Another case is that of a Cargo Tag (220) attached to a Cargo Container (230) which moves past the Interrogator (210) at the maximum range; this case is illustrated in FIG. 5 as Distant Tag (330). Still another case is that of Distant Stacked Tag (340), in which multiple Cargo Containers (230) are stacked on top of each other, and move past the Interrogator (210) at the maximum range. The Nearby Tag (320) could be less than one meter from the Interrogator (310), while the Distant Stacked Tag (340) could be two meters in elevation and five meters from the Interrogator. Therefore, in this example, the minimum vertical Beamwidth (350) is 56°, and to protect against even more extreme situations, the vertical beamwidth should be even greater. Therefore, we conclude that the vertical Receive beamwidth must be greater than the horizontal Receive beamwidth.

We now consider various antenna types which could be used for the Transmit and Receive antennas. To obtain a narrow Receive Beam (260), there are many candidates, including a parabolic dish, a rectangular waveguide horn, or a planar antenna array. The parabolic dish, the most popular microwave antenna, includes a metallic dish in the shape of a paraboloid, and typically has a low noise receiver (LNR) located in its focus. Depending on the portion of the paraboloid that is selected, the axis of the physical dish can be centered or offset with respect to the paraboloid axis. For a typical circular, centered paraboloid dish, its beam width is inversely proportional to the product of dish diameter and the carrier frequency. To get a paraboloid dish with 30° (i.e., ±15°) beam width at 2.45 GHz, the diameter of the dish should be 28.57 cm or 11.25 inches. Therefore, a paraboloid dish less than one foot in diameter is feasible. However, the mechanical structure that mounts the receiver and transmitter in its focus is complex and therefore expensive. Furthermore, a paraboloid dish yields a symmetric antenna pattern in the horizontal and vertical directions, which is contrary to the above requirements.

A rectangular waveguide antenna horn is another candidate for a high gain, narrow beam antenna. A standard waveguide horn with cross-section 14"×10.5" and length 16.75" has 18 dBi directivity and therefore a narrow beam width. However, its 1.5 foot length is quite bulky, and would cause the resulting Interrogator design to be cumbersome. Even a smaller horn using a ridge waveguide is still bulky, about 1 foot long. Such large, heavy metallic waveguide horns are good for fixed terminals or base stations, where plenty space is available and weight is not an issue. For portable base stations, they are too large and heavy.

Finally, we consider a planar antenna as an element in an antenna array. A commercially available slot-fed patch antenna, for instance, is available with 8.5 dBi antenna gain, 75° horizontal beamwidth, and 8% bandwidth. Thus, this antenna should cover from 2300 MHz to 2500 MHz, easily encompassing the 2400–2483.5 MHz ISM band. Furthermore, this antenna is small in size (10.1 cm×9.5 cm×3.2 cm) and light in weight (100 g).

Another attractive planar antenna is a microstrip patch antenna array which consists of etched antenna patches on a circuit board such as FR-4, Duroid, or ceramic. Generally a narrowband device (typically 1% bandwidth), the patch antenna would require a thick board (>125 mils) to achieve a 4% bandwidth. While a large Duroid board (4"×16", for instance, for the 1×4 array described herein) is expensive, the integration of antennas and combiner possible with a patch array makes it an attractive alternative.

Planar antennas can be developed with various polarizations: Righthand Circular Polarization (RCP), Lefthand Circular Polarization (LCP) and Linear Polarization (LP). In general, the polarization between transmit and receive antennas should be matched pairs. In other words, an RCP transmit antenna should communicate with an RCP receive antenna, and an LCP antenna should communicate with an LCP antenna. An LCP or RCP antenna can, however, communicate with an LP antenna with a 3 dB loss (i.e., only one orthogonal component of the signal will excite the LP antenna). Similarly, a linear polarized transmit antenna should communicate with a linear polarized receive antenna. In one embodiment, the Tag uses a linear polarized (LP) quarter wavelength patch antenna. Consequently, linear polarized (LP) transmit and receive antennas are a desirable choice for the Interrogator.

The Tag (220), which is mounted on a moving cargo container (230), changes its orientation continuously; thus making alignment of the antenna orientation, which is directly related to the polarization, a difficult task. The circular polarized antennas are more tolerant of the Tag orientation, although they suffer a 3 dB loss in gain if a linear polarized (LP) Tag antenna is used. All three polarization antennas have been investigated. In practice, it has been found that the linear polarized (LP) antenna is the best choice for the Interrogator. For circularly polarized antennas, the reduced sensitivity to orientation does not seem to compensate for the inherent 3 dB loss when used with the LP Tag antenna. As a result, a linear polarized planar antenna is appropriate for both the transmit and receive antennas in the Interrogator (210).

Figure 6:
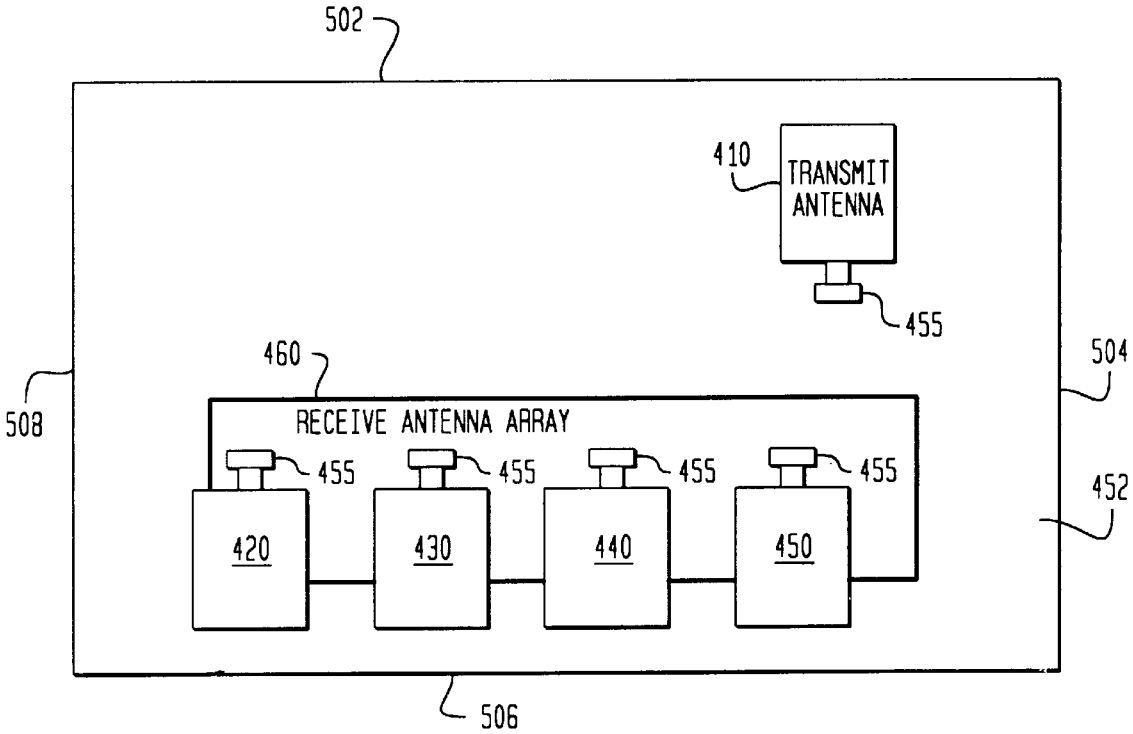
FIG. 6 shows the Cargo Tag antenna system.

To obtain the desired wide transmit beam (250) and narrow receive beam (260), we use one planar antenna as a transmit antenna, and four planar antennas in a 1×4 linear array as a receive antenna. Planar antennas such as slot feed patch antennas from Huber & Suhner AG may be used. All antennas are vertically polarized. As shown in FIG. 6, the transmit antenna (410) is mounted on the upper right comer 4 inches above the 1×4 receive antenna array (420–450). This four inch spacing was chosen to support isolation between the transmit antenna and the receive antenna array. The transmit and receive beam extend perpendicularly from the plane of surface (452). The 1×4 linear array has four antennas (420), (430), (440) and (450) separated by 4 inch spacing. Each antennas has a coaxial connector (455). Four inch spacing was chosen to yield the required ±15° horizontal receive beamwidth. If the spacing were narrowed to two inches or less, then the beamwidth may not be significantly less than the beamwidth of a single planar antenna, thus eliminating the incentive for using an array. The 1×4 array has the advantage that a wide beamwidth is maintained in the vertical plane, while forming a narrow horizontal beamwidth. This design therefore meets the above requirements. Behind the 1×4 linear array, there is a 4-way in-phase microstrip power combiner (460) to sum the four received signals.

Figure 7:
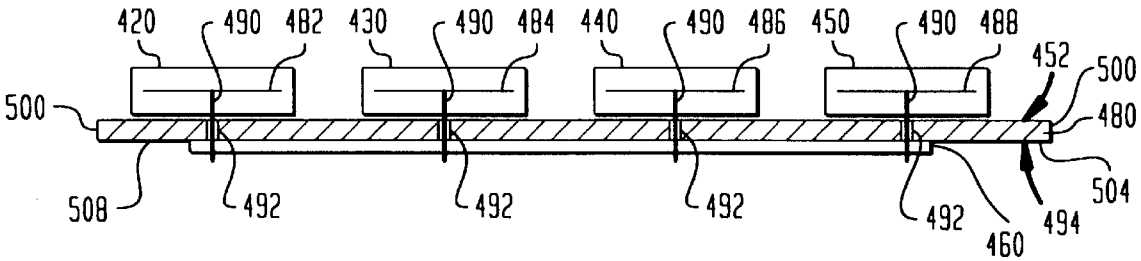
FIG. 7 is a cross section of the antenna system of FIG. 6.

FIG. 7 is a cross section of the antenna array of FIG. 6. The four planar antenna packages (420, 430, 440, and 450) are mounted to board (480). Circuit board (480) may be made of materials such as FR-4, Duriod or ceramic. Surface (452) of board (480) is a conductive surface such as copper and is used as a ground plane. Inside planar antenna packages (420, 430, 440, and 450) are patch antennas (482, 484, 486, and 488), respectively. Microstrip power combiner (460) is etched on surface (494) of circuit board (480). Each patch antenna is electrically connected to microstrip power combiner (460) via a coaxial pin connection (490) through via hole (492).

Figure 8:
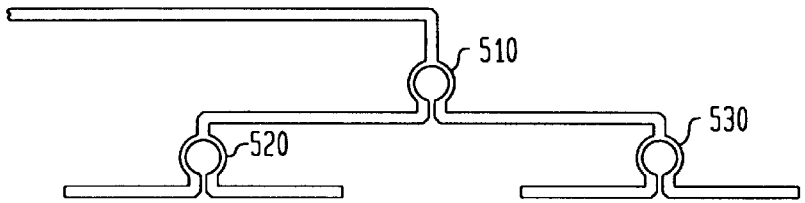
FIG. 8 shows the microstrip power combiner used in the Cargo Tag antenna system.
Figure 8A:
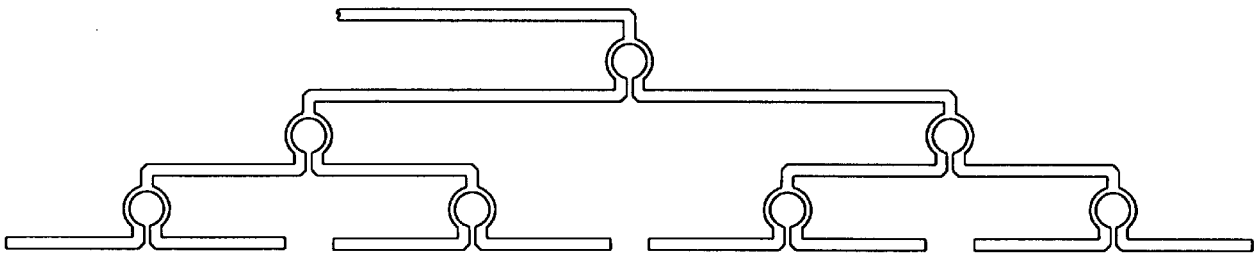
FIG. 8A illustrates a microstrip power combiner having three stages of two element combiners.

As shown in the embodiment of FIG. 8, this 4-way microstrip combiner is made of three binary combiners (510), (520) and (530), etched on a circuit board. In one embodiment, the circuit board uses the material FR-4. Four via holes are etched at the end tips, allowing coaxial pin connections to the four planar antennas on the other side of the board. The four antennas are mounted directly to the ground plane of the 4-way combiner. Thus, the 4-way microstrip power combiner is mounted back-to-back with the 4 planar antennas in front. In this manner, the combiner provides not only the ground plane, but also the spacing and mechanical structure for the 1×4 linear antenna array.

Furthermore, to reduce crosstalk between the transmit antenna and the receive antenna, it is found that the receive antenna array works better with the 4-way microstrip combiner shielded along its four edges. In one embodiment, as illustrated in FIGS. 6 and 7, this shielding uses adhesive copper tape (500), attached between all four edges (502, 504, 506 and 508) of the microstrip combiner antenna assembly. This copper tape shielding prevents the CW power radiated from the transmit antenna from leaking into the combiner and saturating the low noise amplifier (LNA). With copper tape shielding, it is found that the receive sensitivity is significantly improved.

Figure 9:
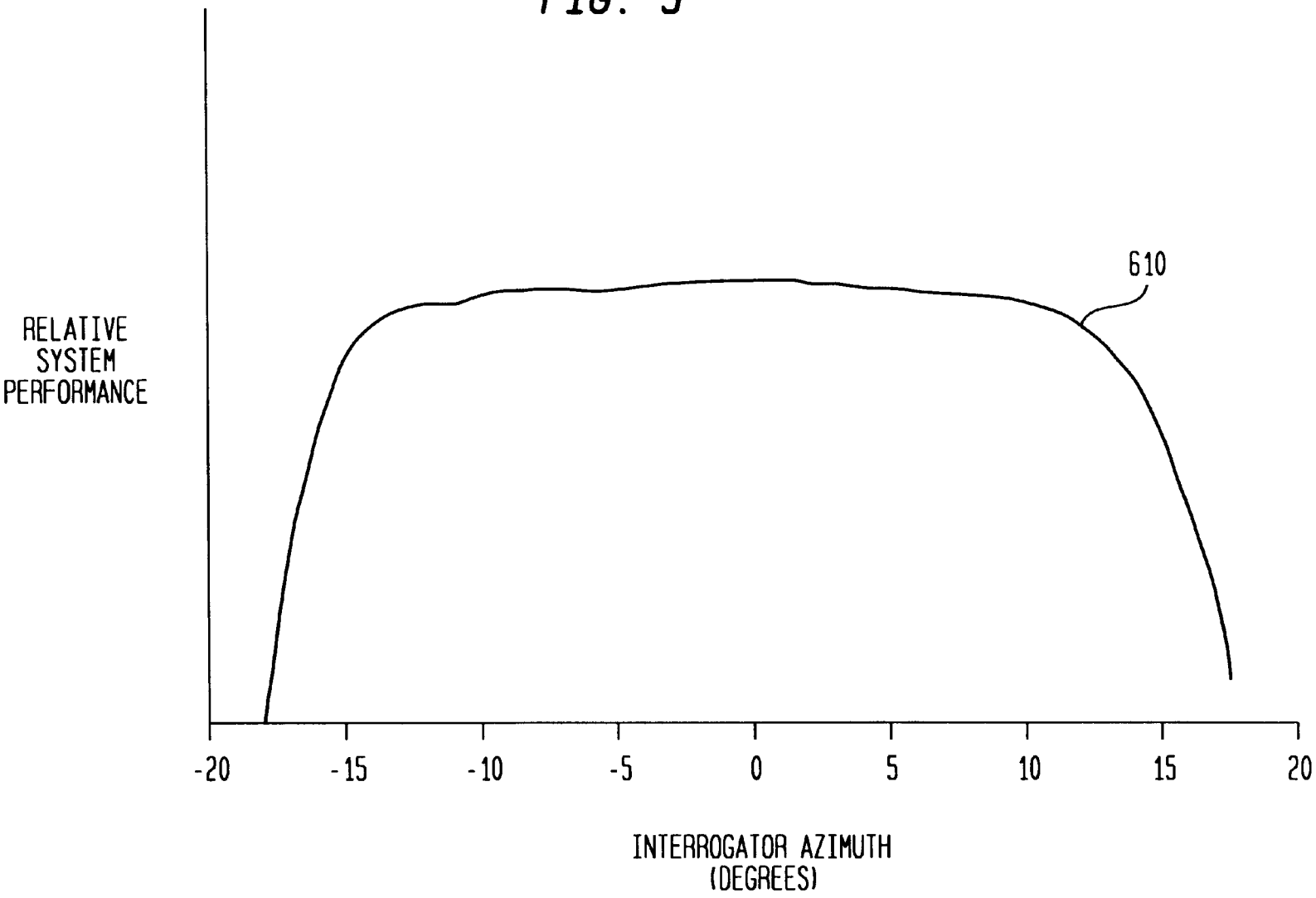
FIG. 9 shows the measured system performance versus azimuth angle.

The antenna pattern of the 1×4 linear receive antenna array disclosed above has been measured in the horizontal or azimuth plane. The main lobe has a 3 dB beam width at ±12°, with a first null located at ±16°. Several sidelobes were also observed, but their amplitudes are at least 13 dB below the amplitude of the main lobe. FIG. 9 shows the system performance (610) as the Tag (220) is swept across the entire mainlobe from −20° to +20° azimuth angles. As shown in FIG. 9, the system performance is almost flat within the 30° degree (−15° to +15°) beamwidth. The system performance drops sharply as the tag is moved out of the beam.

In the above disclosure, we have used a four-element array of planar antennas. In other embodiments, a different number of antennas could also have been used. This embodiment may be extended to a two-element array. The microstrip combiner of FIG. 8 would be simplified to have one combining element (such as 520) to combine the signals from the two planar antennas. The distance between the two planar antennas would be selected to optimize the azimuth antenna pattern.

In addition, an eight antenna planar array could have been used, and the microstrip combiner extended to have three "stages" of two-element combining rather than the two "stages" shown in FIG. 8. Extending the number of antennas to eight would allow the beam width to be further reduced; however, the same goal could also be achieved by increasing the spacing between each element of the four element planar antenna array disclosed above. Furthermore, the use of eight antennas may be cumbersome, since the width of the Interrogator would be extended.

What has been described is merely illustrative of the application of the principles of the present invention. Other arrangements and methods can be implemented by those skilled in the art without departing from the spirit and scope of the present invention.

We claim:

1. A radio frequency identification system, comprising:

an interrogator having a transmit antenna and a receive antenna, an antenna gain of said transmit antenna being less than an antenna gain of said receive antenna, and a vertical beamwidth of said receive antenna being greater than a horizontal beamwidth of said receive antenna.

2. The radio frequency identification system of claim 1, wherein said receive antenna comprises N planar antenna elements configured in a 1×N array, where N is one of 2, 4, and 8.

3. The radio frequency identification system of claim 1, wherein said transmit antenna is a single planar antenna.

4. The radio frequency identification system of claim 1, wherein said transmit and receive antennas are separated by at least two inches.

5. The radio frequency identification system of claim 1, wherein said transmit and receive antennas are linearly polarized.

6. The radio frequency identification system of claim 5, wherein the receive antenna comprises N planar antenna elements, each separated by at least two inches.

7. The radio frequency identification system of claim 5, wherein the receive antenna comprises N planar antenna elements and the signals from said N planar antenna elements are combined using an in-phase power combiner.

8. The radio frequency identification system of claim 7, wherein in-phase power combiner is electrically shielded along its edges.

9. The radio frequency identification system of claim 7, wherein the receive antenna comprises four planar elements, and said in-phase power combiner comprises three binary combiners in cascade.

10. The radio frequency identification system of claim 9, wherein said four planar antenna elements are mounted back-to-back with said in-phase power combiner.

* * * * *